166-308 SR
9/23/80 XR 4,223,734

United States Patent [19]
Lekas
[11] 4,223,734
[45] Sep. 23, 1980

[54] PROCESS OF BREAKING AND RENDERING PERMEABLE A SUBTERRANEAN ROCK MASS

[75] Inventor: Mitchell A. Lekas, Concord, Calif.
[73] Assignee: Geokinetics Inc., Concord, Calif.

[21] Appl. No.: 959,070
[22] Filed: Nov. 9, 1978
[51] Int. Cl.[2] ..... E21B 43/263; E21C 43/00; E21B 43/28
[52] U.S. Cl. ..... 166/299; 166/308; 102/23; 299/4; 299/13
[58] Field of Search ..... 166/299, 308, 309, 295, 166/259, 271; 299/4, 13; 102/23

[56] References Cited

U.S. PATENT DOCUMENTS

| | | | |
|---|---|---|---|
| 2,952,449 | 9/1960 | Bays | 166/271 X |
| 3,106,244 | 10/1963 | Parker | 166/271 X |
| 3,136,361 | 6/1964 | Marx | 166/308 |
| 3,379,253 | 4/1968 | Chism | 166/295 |
| 3,533,471 | 10/1970 | Robinson | 166/299 |
| 3,608,639 | 9/1971 | Hart | 166/308 |
| 3,616,855 | 11/1971 | Colgate | 166/299 X |
| 3,771,600 | 11/1973 | Hill | 166/299 |
| 3,937,283 | 2/1976 | Blauer et al. | 166/308 X |
| 3,957,306 | 5/1976 | Closmann | 166/299 X |
| 4,037,657 | 7/1977 | Lekas | 166/299 X |

*Primary Examiner*—Stephen J. Novosad
*Attorney, Agent, or Firm*—Warren, Chickering & Grunewald

[57] ABSTRACT

The process of the present invention involves the following steps:

- producing, as by hydrofracing, a substantially horizontal fracture in the subterranean rock mass to be processed;
- emplacing an explosive charge in the mass in spaced juxtaposed position to the fracture;
- enlarging the fracture to create a void space thereat, an initial lifting of the overburden, and to provide a free face juxtaposed to and arranged to cooperate with the emplaced explosive charge; and
- exploding the charge against the free face for fragmenting the rock and to distribute the space, thus providing fractured, pervious, rubble-ized rock in an enclosed subterranean chamber.

Firing of the charge provides a further lifting of the overburden, an enlargement of the chamber and a larger void space to distribute throughout the rubble-ized rock within the chamber. In some forms of the invention an explosive charge is used to produce a transitory enlargement of the fracture, and the juxtaposed emplaced charge is fired during the critical period of enlargement of the fracture.

10 Claims, 18 Drawing Figures

PROCESS OF BREAKING AND RENDERING PERMEABLE A SUBTERRANEAN ROCK MASS

BACKGROUND OF THE INVENTION

1. Field of Invention

The invention relates to processes for producing an underground zero of fragmented and pervious material which may be used as a storage area, as a passage or aquifier, for treatment of materials, for ore body leaching or recovering of carbonaceous materials from subterranean deposits, etc. The present process is considered to be a general one of breaking and rendering permeable a mass of rock underneath an impermeable mass of rock and may be used in the production of in situ retorts in oil shale deposits, extracting oil from tar sands, in situ gasification of coal, leacing copper out of a copper deposit or uranium out of a uranium deposit. Essentially, the present process is directed to the selective breaking of a mass of rock in the ground without breaking all of the rock up to the surface.

2. Description of Prior Art

As is well known, large amounts of hydrocarbon oil are contained in subterranean oil shale deposits, and the economic recovery of such oil, and/or hydrocarbon gases, has been a long-sought-after objective. Access to the oil shale may be obtained by removing the overburden by strip mining procedure, However, such procedure is both costly and deleterious to the terrain. Efforts have accordingly been made to extract the oil and valuable hydrocarbon gases by the production of subterranean retorts in the oil shale deposit with minimum disturbance of the land surface. An example of such procedure is disclosed in my U.S. Pat. No. 4,037,657. Another technique for the production of the subterranean retort is the application Ser. No. 895,243 of Daniel P. Zerga, filed Apr. 10, 1978.

SUMMARY OF THE INVENTION

I have found that the breaking and the rendering permeable of a subterranean rock mass may be effectively and efficiently accomplished by the process of the present invention which consists briefly of:

- producing, as by hydrofracing, a fracture in the rock mass;
- emplacing an explosive charge in the rock in spaced confronting relation to the fracture;
- enlarging the fracture to create thereat space and a free face at a side of the fracture confronting the charge; and
- exploding the charge against the free face for fragmenting the rock and to distribute the space, thus producing a chamber filled with fractured, pervious, rubble-ized rock.

An object of the present invention is to provide a process of the character described which is sure, efficient, and effective in the production of the subterranean chamber of fractured, pervious, rubble-ized rock with minimum disturbance of, or damage to, the ground surface; and while preserving, intact and with good integrity, an overburden lid or closure for the chamber.

Another object of the present invention is to provide a process of the character described, requiring minimum ground preparation, and which uses dependable techniques and efficient use of explosives as well as avoiding wasteful escape to the atmosphere of explosively generated gases.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 2:
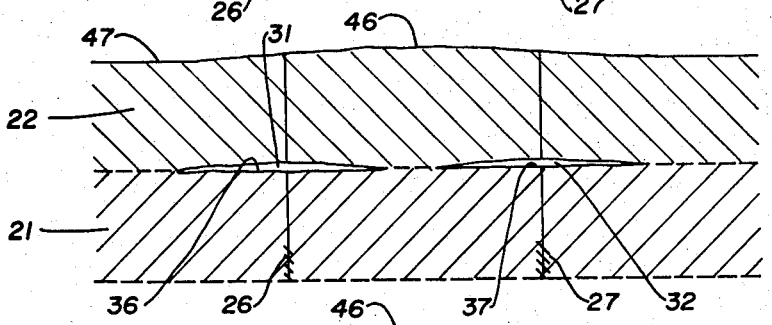
FIG. 2 is a view similar to FIG. 1, but showing an intermediate step of the process.

The process of the present invention is designed for breaking and rendering permeable a subterranean mass of rock 21 covered by an overburden 22 and comprises, briefly, the producing in the rock of one or more fractures 23 and 24; emplacing an explosive charge 26 in the rock mass in spaced confronting relation to the fracture; enlarging the fracture, see FIG. 2, to create thereat space 31 and a free face 36 at a side of the fracture confronting charge 26; and exploding charge 26 against free face 36 for fragmenting rock therebetween and to distribute space 31, thus producing a chamber 41 filled with fractured, pervious, rubble-ized rock 42. In the foregoing process, overburden 22 may be raised slightly with the enlarging of fracture 23, producing a small crown 46 at ground surface 47. On firing of charge 26, the explosive gases released and contained in chamber 41 produce a further lifting of the overburden, see FIG. 3, thus affording additional space within the chamber for distribution through the rubble-ized rock to provide requisite permeability. The enlargement of fracture 23 provides a medium therein of different density than the surrounding rock to create a reflecting surface for explosive 26.

The hydrofrac process for producing a fracture in subterranean rock is well understood in the art. A fluid pressure medium, such as water, is forced under pressure into the rock at the location where fracturing is to be initiated. As the fracturing fluid is forced into the rock, the fracture is caused to propagate away from the point of entry of the fluid. In the present case, a bore hole 51 is drilled from the surface 47 vertically down into the rock 21, a fluid inlet pipe (not shown) is sealed in bore hole 51 and has its lower discharge end located at the plane where hydrofracing is to occur, bore hole 51 being stemmed below the plane of intended fracture. The fracture produced is a thin crack which may be propagated out in all directions and for many feet from the point of origin. Thickening agents in the hydrofrac fluid may be employed to increase, somewhat, the depth of the fracture, and to carry sand grains out into the fracture.

There are several methods which may be used for making the requisite enlargement in the fracture to carry out the purposes of the present invention. One method is the use of one of a number of foams that may be injected into the fracture, the foam being quite viscous in flowing through the fracture, and accordingly developing lifting force on the overburden to develop the space and free face above discussed. Since the foam is mostly air, it has excellent reflecting characteristics. The foam may be a normal, unstable foam that would break down in time, e.g., a liquid-air-type foam, or it could be some kind of a setting material, e.g., Styrofoam (polystyrene), which would stand for a longer period of time. Also, the liquid-foam-producing components may be selected to provide, within themselves, a strong expanding force. The required force need overcome the weight of the overburden, and the foaming characteristics may be tailored to exert maximum lifting force. The overburden pressures involved in this application are essentially the lithostatic pressure of the overlying rock, which is about one pound per square inch per foot of distance from the fracture to the surface. It is contemplated that the present invention will commonly be used at working depths in the order of 200 to 600 feet, which would involve about 200 psi to 600 psi of overburden pressure. Aside from the expanding power of the foam itself, pressures of this magnitude may readily be generated by a pump forcing the hydrofrac liquid into the crack.

Figure 1:
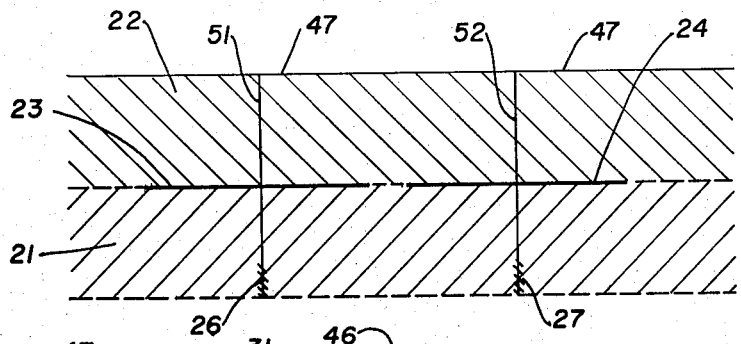
FIG. 1 is a vertical cross-sectional view of a ground preparation used in practicing the invention.
Figure 3:
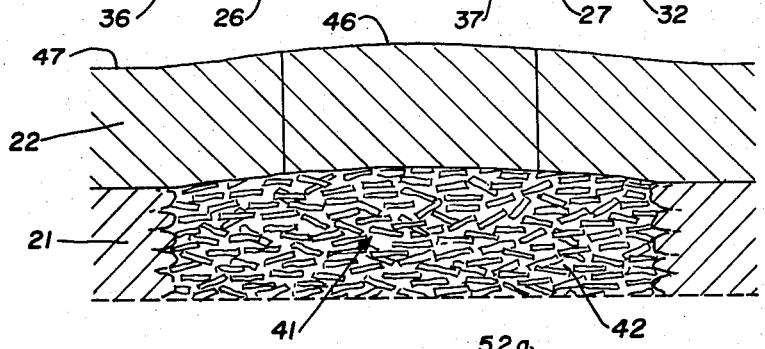
FIG. 3 is a cross-sectional view similar to FIGS. 1 and 2, but showing the completed subterranean chamber filled with fractured, pervious, rubble-ized rock.

With reference to FIGS. 1–3, a plurality of bore holes, such as 51 and 52, may be used to produce a pair of hydrofracs 23 and 24, preferably on or near a common plane. Charge 26 may be emplaced in the lower end of bore hole 51 and a similar charge 27 may be emplaced in the lower end of bore hole 52, thus positioning these charges in proper spaced confronting relation to fractures 23 and 24. The latter may then be first opened using one of the foam techniques discussed above, thus optimizing the reflective characteristics of the fractures and creating spaces 31 and 32, and free faces 36 and 37, (see FIG. 2). Subsequent firing of charges 26 and 27 provide the generally increased volume of rubble-ized rock 42, as seen in FIG. 3. Further enlargement of the enclosed retort chamber 41 and rubble-ized rock mass 42 may be effected by the use of additional numbers of bore holes.

Figure 4:
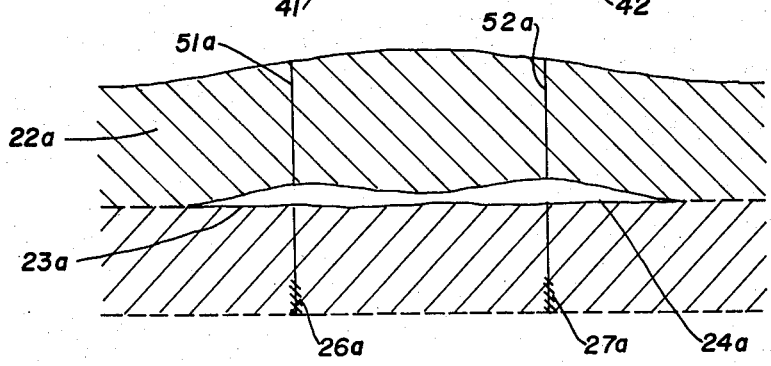
FIG. 4 is a vertical cross-sectional view of an interim step in a second form of the invention.
Figure 5:
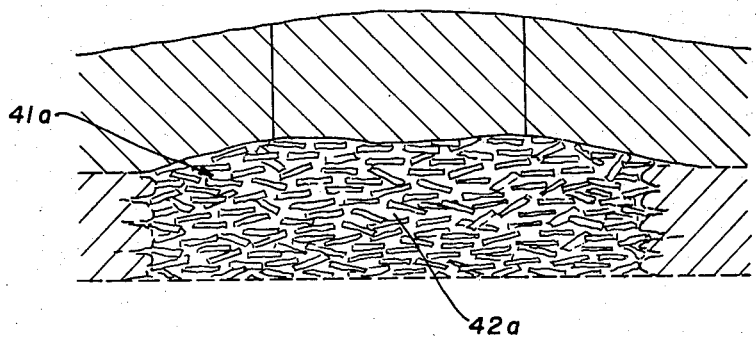
FIG. 5 is a similar view of the completed process.

Another technique of the present invention, and illustrated in FIGS. 4 and 5 of the drawings, is the use of an explosive for producing a transitory enlargement of the hydrofrac. In such case, and as an important feature of the present invention, the fragmenting charges confronting the transistorily enlarged hydrofrac are fired during the period of enlargement. With reference to FIG. 4, fractures **23*a* and 24*a* may be first formed by hydrofracing, as illustrated in FIG. 1, liquid explosive may then be pumped into the fractures and fired to produce a transitory opening of the fractures as seen in FIG. 4. Thereafter, charges 26*a* and 27*a* emplaced in the lower ends of bore holes 51*a* and 51*b* are fired to produce rubble-ized rock 42*a* in chamber 41*a*. The firing of liquid explosive in fractures 23*a* and 24*a* provides an initial uplift of overburden 22*a*, as seen in FIG. 4, and the explosive power of charges 26*a* and 27*a* produces still a further lifting of the overburden as seen in FIG. 5. The detonation of the liquid explosive fills the fracture with gases formed by the explosion to provide the desired reflecting surface for the lower emplaced explosive charges 26*a* and 27*a***. A delay is used in firing these latter charges to coincide with the expansion of the fractures to optimum size.

Figure 6:
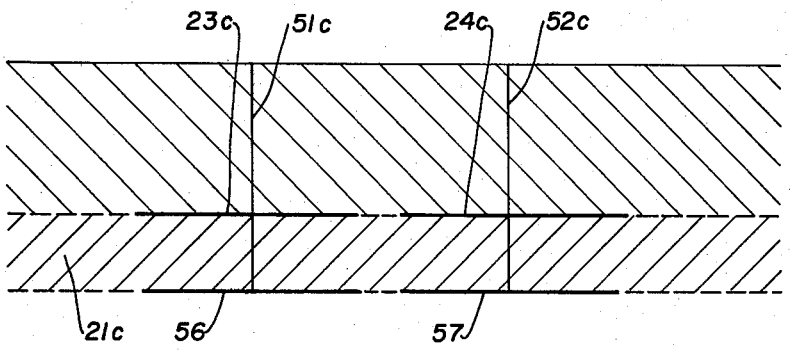
FIG. 6 is a vertical cross-sectional view depicting a third form of the invention.
Figure 7:
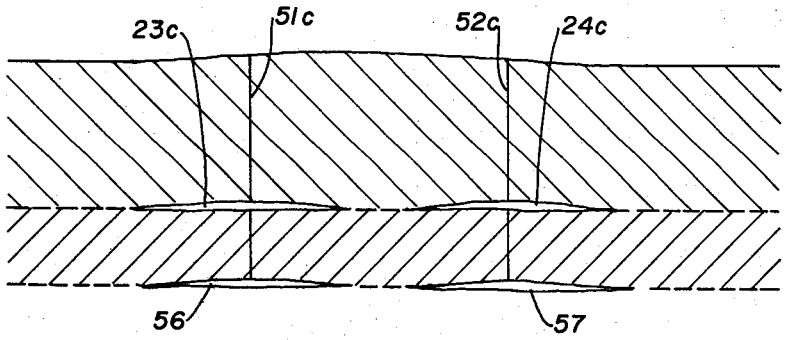
FIGS. 7, 8, and 9 depict interim and completed stages of the process.
Figure 8:
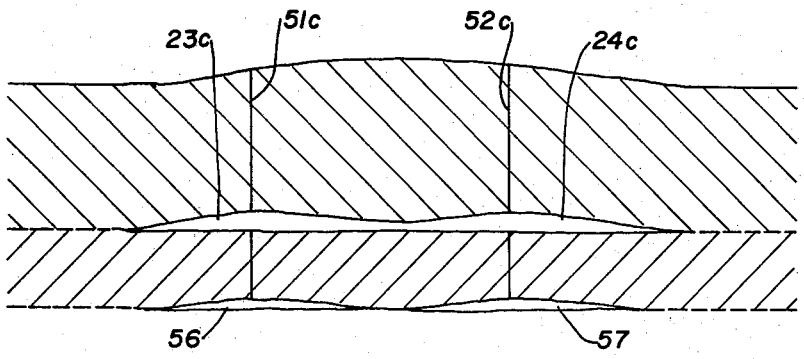
Figure 9:
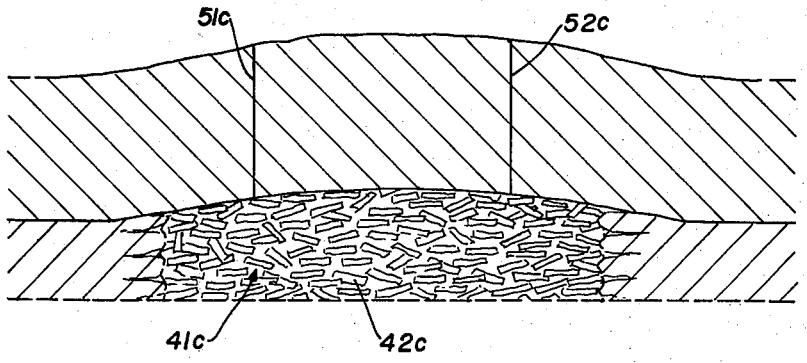

A further form of the invention is illustrated in FIGS. 6–9, wherein the fragmenting charges are emplaced in other fractures as liquid explosives. With reference to FIG. 6, there is first prepared, in the rock **21*c*, substantially vertically superimposed, substantially horizontally extending fractures 23*c* and 56, which delineate between them the mass of rock to be fragmented. Liquid explosive is pumped into fractures 23*c* and 56 as seen in FIG. 7. One of the liquid explosives, preferably the upper one, is fired to produce a transitory enlargement of the fracture as seen in FIG. 8. Thereafter, the other liquid explosive is fired to produce a fragmenting of the rock between the fractures as seen in FIG. 9. Fractures 23*c* and 56 may be produced by hydrofracing technique from bore hole 51*c*; and a second pair of laterally-spaced fractures 24*c* and 57 may be prepared using laterally-spaced bore hole 52*c*. These fractures may be charged in the manner discussed above, and fired simultaneously or with appropriate delays with their companion laterally spaced charges to produce rubble-ized rock 41*c* in a generally enlarged rubble-filled chamber 42*c*, as depicted in FIG. 5**. The use of two sets of such fractures is illustrated only. These may be replicated to scale up the area of fragmentation.

Figure 10:
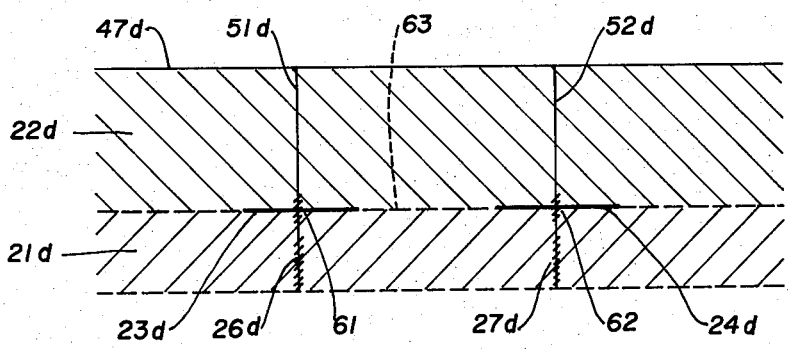
FIG. 10 is a vertical cross-sectional view depicting a fourth form of the process of the present invention.
Figure 11:
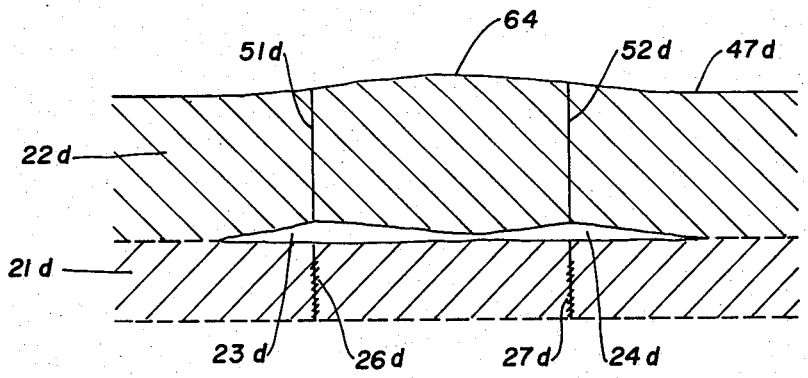
FIGS. 11 and 12 depict interim and completed stages of such process.
Figure 12:
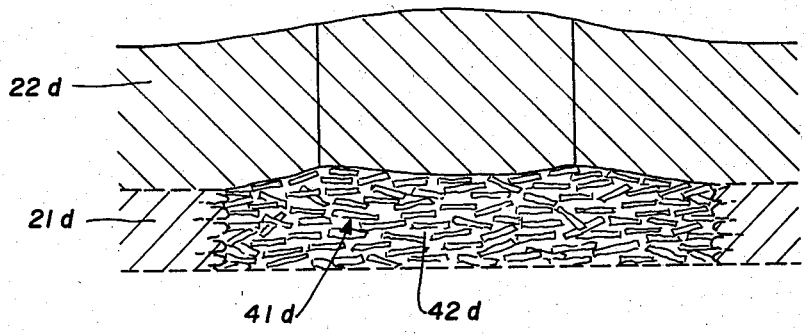

Another form of the present invention is illustrated in FIGS. 10–12, wherein a plurality of bore holes **51*d* and 52*d* are drilled from the surface 47*d* vertically down through overburden 22*d* and into the area of rock 21*d* to be fragmented. Fractures 23*d* and 24*d* are formed in the upper regions of area 21*d* by conventional hydrofracing techniques. Thereafter, explosive charges 26*d* and 27*d* are emplaced in the lower ends of bore holes 51*d* and 52*d* and explosive charges 61 and 62 are emplaced in bores 51*d* and 52*d* at fractures 23*d* and 24*d*. Exploding of charges 61 and 62 will produce the injection of gases of explosion into fractures 23*d* and 24*d* resulting in a raising of overburden 22*d*, as seen by the crowning effect at 64 of the ground surface 47*d* in FIG. 11. Firing of charges 61 and 62 produce a transitory opening of fractures 23*d* and 24*d* and a free face against which subsequent blasting of charges 26*d* and 27*d* may take place. Firing of charges 26*d* and 24*d* in timed relation to the opening of fractures 23*d* and 27*d* will produce a permeable rubble-ized rock volume 42*d* in subterranean chamber 41*d***.

Figure 13:
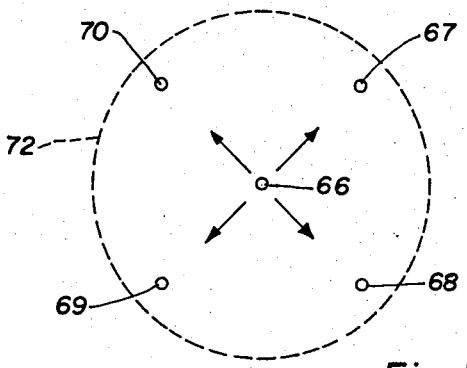
FIG. 13 is a plan view depicting a fifth form of the invention.
Figure 14:
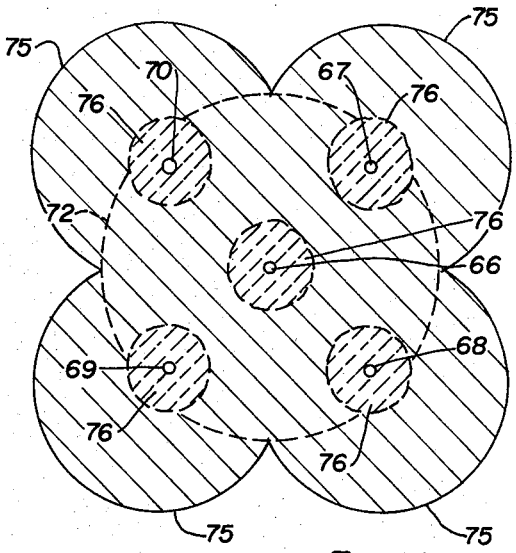
FIG. 14 is a cross-sectional view of the ground preparation of FIG. 13, and is taken substantially on the line of 14—14 of FIG. 15.
Figure 15:
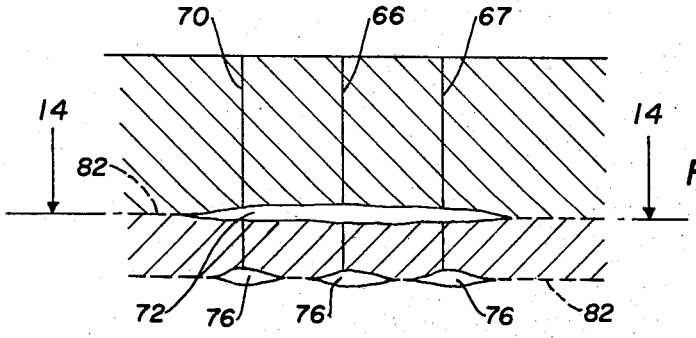
FIG. 15 is a vertical sectional view of the ground preparation depicted in FIGS. 13 and 14, for breaking and rendering permeable a rock mass.
Figure 16:
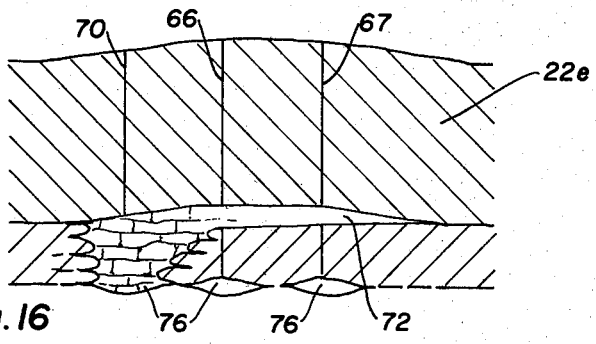
FIGS. 16 and 17 are vertical sectional views depicting interim and completed stages of the process illustrated in FIGS. 14 and 15.

A further modified form of the invention is illustrated in FIGS. 13 to 17 in which a number of bore holes 66, 67, 68, 69, and 70 are drilled in a pattern, such as a 5-spot pattern as seen in FIG. 13. An initial fracture 72 is driven outwardly from bore hole 66, and preferably propagated well past the peripheral pattern of bore holes 67–70. Fracture 72 may be further enlarged by pumping a hydrofracting fluid into fracture 72 from bore holes 67–70, see enlargements 75 in FIG. 14.

Where such an extended fracture is to be used for the purpose of breaking and rendering permeable a rock mass, a plurality of fractures 76 is formed by hydrofracting from each of the bore holes 66–70 at positions vertically positioned below the enlarged fracture 72. Liquid explosive may then be injected into fracture 72 and each of the fractures 76. Firing of the explosive in fracture 72 is first effected to create a transitory enlargement thereof and a free face related to fractures 76. Thereafter and in timed relation to the optimum enlargement of fracture 72, charges in fractures 76 are fired against the free face produced at fracture 72 for fragmenting rock therebetween and generating a volume of gas which will produce a further lifting of the overburden. Fractures 76 may be extended laterally to connect in one large fracture. Where individual fractures are used, as here shown, suitable delays in the firing of the charges in fractures 76 may be used, as illustrated in FIG. 16 to maximize rock breakage.

Figure 18:
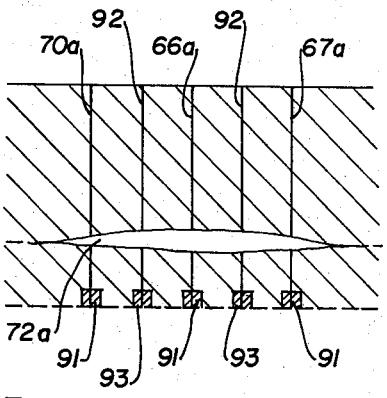
FIG. 18 is a vertical cross-sectional view depicting a further alternative form of the process of the present invention.
Figure 17:
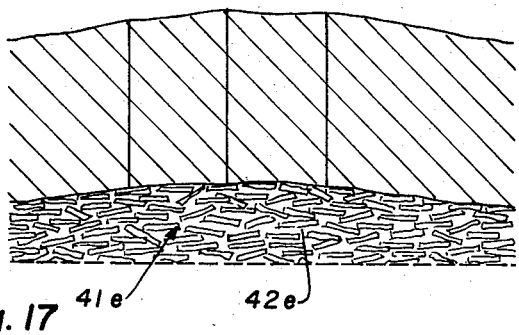

A further alternative structure is illustrated in FIG. 18 wherein a plurality of charges 91 is emplaced in bore holes **66*a*–70*a* below the enlarged hydrofrac 72*a* produced as described above. Again, liquid explosive injected into fracture 72*a* is fired to produce a transitory enlargement of the fracture and charges 91 are fired in timed relation to such enlargement, as above described, to effect fragmentation of the rock mass. Additional bore holes 92 may be drilled from the surface, not necessarily for assisting in production of hydrofrac 72*a*, but for emplacement of additional charges 93 below the enlarged fracture 72*a***.

Liquid explosive need not fill the entire plane of the fracture in which it is injected, but may penetrate sufficiently to occupy 10 to 50 percent of the fracture area. This is generally true of all of the forms of the present invention using liquid explosive. Any suitable, stable, pumpable liquid explosive, well known in the blasting art and available commercially, may be used for carrying out the processes of the present invention.

What is claimed is:

1. The process for breaking and rendering permeable a subterranean mass of rock comprising:

hydrofracing substantially vertically superimposed substantially horizontally extending fractures in said mass delineating rock to be fragmented;

pumping of a liquid explosive into one of said fractures;

firing an explosive in the other of said fractures to produce a transitory enlargement thereof and to provide a free face; and firing said liquid explosive during the period of said enlargement.

2. The process of claim 1, and pumping a liquid explosive into said other fracture to provide said second-named explosive and to provide said transitory explosive enlargement of said other fracture.

3. The process for breaking and rendering permeable a subterranean mass of rock comprising:

boring a hole from the surface into said mass;

hydrofracing a fracture from said bore hole;

emplacing a first explosive charge in said bore hole spaced from said fracture;

emplacing a second explosive charge in said bore hole at said fracture;

exploding said second charge to produce a transitory enlargement of said fracture and space therein and a free face; and exploding said first charge during the period of said enlargement for fragmenting said rock between said charges and to distribute said space, thus producing fractured pervious rubble-ized rock in said area.

4. The process for breaking and rendering permeable a subterranean mass of rock comprising:

hydrofracing a fracture in said mass;

emplacing an explosive charge in said mass in spaced confronting relation to said fracture;

firing an explosive in said fracture to produce a transitory enlargement thereof and a free face confronting said charges; and exploding said charge during the period of said enlargement and against said free face for fragmenting said rock and to distribute said space, thus producing a chamber filled with fractured pervious rubble-ized rock.

5. The process of claim 4, said step of enlarging said fracture comprising the pumping into said fracture under pressure of a liquid explosive and firing said explosive.

6. The process of creating a fracture in a subterranean rock mass comprising:

boring a plurality of substantially vertical holes from the surface into said mass, said holes being arranged in a pattern having a center hole and a plurality of outer holes circumferentially positioned around said center hole;

hydrofracing from said center hole to produce a fracture driven outwardly therefrom to intersect said outer holes;

injecting hydrofracing fluid through said outer holes into said fracture, thereby extending said fracture laterally and producing an enlargement thereof;

emplacing explosive charges in said holes in spaced confronting relation to said fracture;

firing an explosive in said fracture to produce a transitory enlargement thereof and a free face confronting said charges; and exploding said charges during the period of said enlargement.

7. The process of claim 6 for breaking and rendering permeable said rock mass comprising:

hydrofracing from said outer holes a plurality of second fractures vertically offset from said first-named fracture;

injecting liquid explosive into said first-named fracture;

injecting liquid explosive in said second fractures;

firing the explosive in said first-named fracture to effect enlargement thereof and creating a free face related to said second fractures; and firing said explosive in said second fractures against said free face for fragmenting said rock therebetween.

8. The process of claim 7, said bore holes being arranged in a 5-spot pattern.

9. The process of claim 6 for breaking and rendering permeable said rock mass comprising:

injecting liquid explosive into said fracture;

emplacing second explosive charges in said outer bores at positions below said first fracture;

firing the explosive in said first fracture to effect enlargement thereof and creating a free face related to said second charges; and firing said second charges against said free face for fragmenting said rock therebetween.

10. The process of claim 6, hydrofracing from said outer holes a plurality of second fractures vertically offset from said first-named fracture;

injecting liquid explosive into said second-named fractures;

firing an explosive in said first-named fracture to produce a transitory enlargement thereof and a free face confronting said second fractures; and firing said liquid explosives during the period of said enlargement and against said free face for fragmenting said rock and to distribute said space, thus producing a chamber filled with fractured pervious rubble-ized rock.

* * * * *

UNITED STATES PATENT AND TRADEMARK OFFICE

CERTIFICATE OF CORRECTION

PATENT NO. : 4,223,734

DATED : September 23, 1980

INVENTOR(S) : Mitchell A. Lekas

It is certified that error appears in the above-identified patent and that said Letters Patent are hereby corrected as shown below:

Col. 1, line 9, delete "zero" and insert ---zone---; and

Col. 1, line 18, delete "leacing" and insert ---leaching---.

Signed and Sealed this

*Twenty-third* Day of *December 1980*

[SEAL]

*Attest:*

SIDNEY A. DIAMOND

*Attesting Officer*

*Commissioner of Patents and Trademarks*